United States Patent [19]

Gusack et al.

[11] Patent Number: 4,545,835

[45] Date of Patent: Oct. 8, 1985

[54] METHOD OF FORMING SUPPORTED ANTISTATIC YARN

[75] Inventors: James A. Gusack; Thomas E. Smith, both of Williamsburg, Va.

[73] Assignee: Badische Corporation, Williamsburg, Va.

[21] Appl. No.: 504,359

[22] Filed: Jun. 15, 1983

[51] Int. Cl.[4] ..... D02G 3/04

[52] U.S. Cl. ..... 156/180; 57/297; 57/901; 156/290; 156/308.6; 428/368; 428/372; 428/373; 428/395; 428/922

[58] Field of Search ..... 156/180, 305, 308.6, 156/166, 290; 428/368, 373, 372, 374, 378, 395, 922; 57/901, 251, 258, 297, 242

[56] References Cited

U.S. PATENT DOCUMENTS

| | | | |
|---|---|---|---|
| 3,388,030 | 6/1968 | Estes et al. | 156/180 |
| 3,409,493 | 11/1968 | McIntyre et al. | 156/166 |
| 3,945,186 | 3/1976 | Van Dort | 428/375 |
| 4,016,329 | 4/1977 | Matsuyama et al. | 428/395 |
| 4,107,914 | 8/1978 | Van Dort | 428/361 |
| 4,255,487 | 3/1981 | Sanders | 428/372 |

*Primary Examiner*—Michael Ball

*Attorney, Agent, or Firm*—R. B. Hurley, Jr.

[57] ABSTRACT

Disclosed is a method of making a supported antistatic yarn and products resulting therefrom. The method involves merging a support yarn into contact with a filamentary polymer substrate immediately after the filamentary substrate has had a mix applied thereto. The support yarn is solvent bonded to the polymer substrate due to the characteristics of the mix.

7 Claims, 5 Drawing Figures

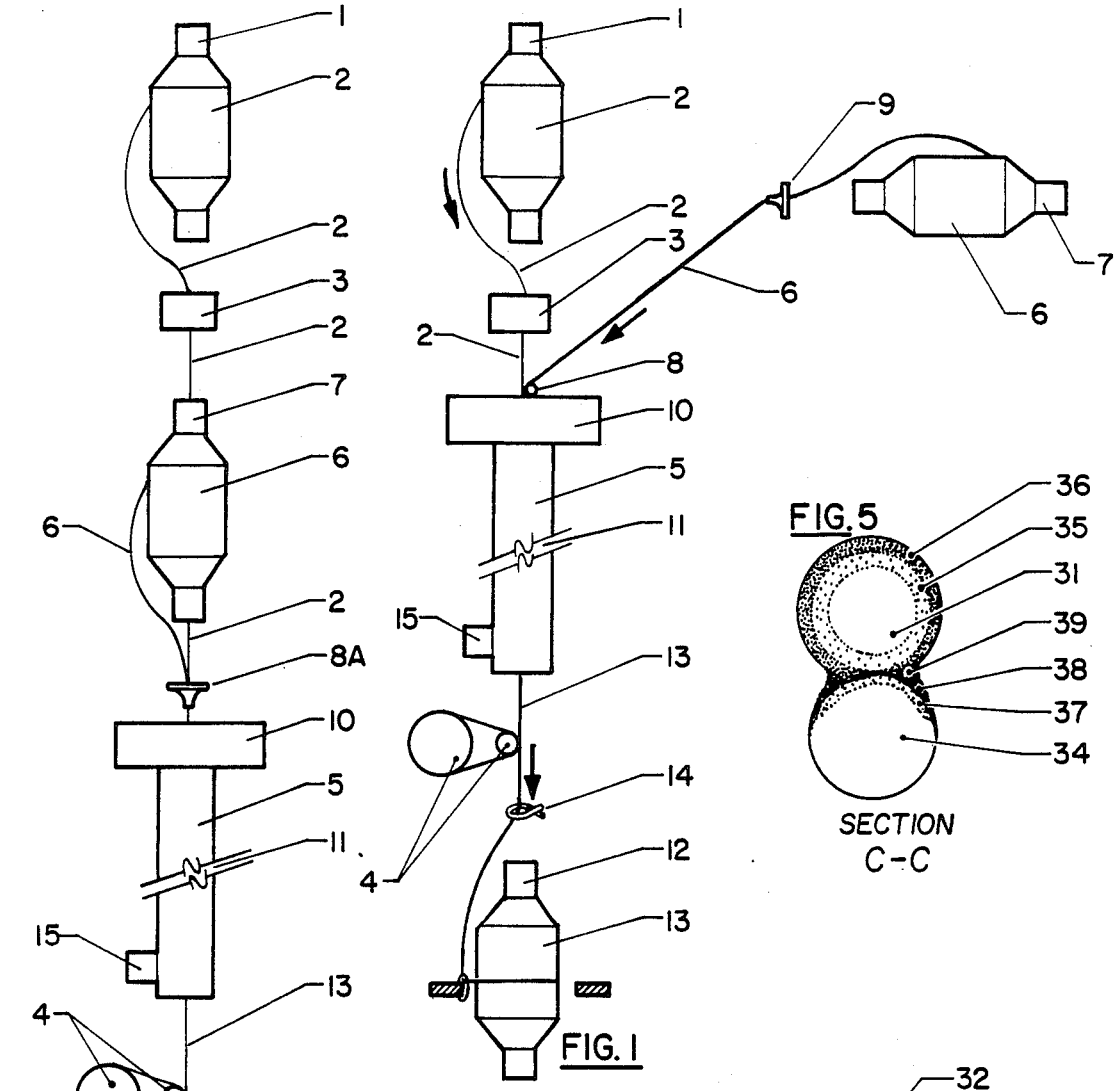
1
2
9
3
6
7
8
10
5
11
15
13
14
12
4
FIG. 1
FIG. 5
36
35
31
39
38
37
34
SECTION
C-C
8A
FIG. 2
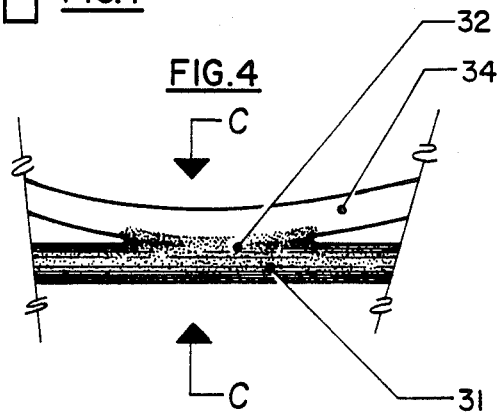
FIG. 4
C
32
34
31
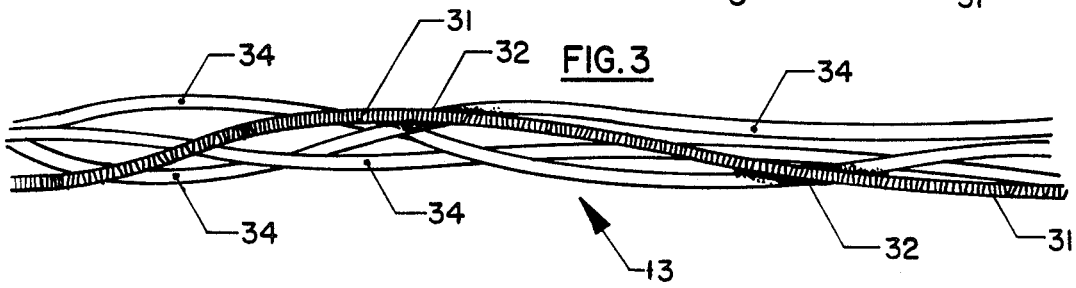
FIG. 3
34
31
32
13

METHOD OF FORMING SUPPORTED ANTISTATIC YARN

BACKGROUND OF THE INVENTION

1. Field of the Invention

The present invention pertains to the fields of stock materials and antistatic fibers. The present invention relates to stock materials which are strands, the strands being impregnated with free carbon (i.e. conductive carbon black particles), these impregnated strands being used as antistatic textiles. More specifically, the present invention pertains to an antistatic textile yarn which is strengthened by being solvent bonded to a support yarn.

2. Description of the Prior Art

Several U.S. patents are related to the general area within which the present invention is located. However, applicants do not believe that any of these patents cover the process or products of the present invention. The closest prior art known to applicants includes the following U.S. Pat. Nos. 4,255,487; 3,823,035; 3,647,591; 4,107,914; 3,945,186; 3,206,923; 3,291,897. The relationship between the present invention and each of these patents is discussed below.

U.S. Pat. No. 4,225,487 and U.S. Pat. No. 3,823,035, to Sanders, disclose a process of suffusing conductive carbon black particles into a polymeric substrate. The Sanders patents do not refer to any process for supporting conductive strands with nonconductive strands. The Sanders patents do, however, disclose a process which forms a very important part of the process of the present invention. The present invention is an improvement on the Sanders patents in the instances in which a conductive strand subsequently undergoes the downstream process operations of warping, weaving, knitting, etc. The present invention requires additional process steps over those steps described in both Sanders patents. Both Sanders patents are hereby incorporated by reference.

U.S Pat. No. 3,657,591 discloses a process for making acid bonded nonwoven fabrics. In this patent a nonwoven fabric containing a blend of staple fibers is contacted by an acid which softens only a specific type of fiber in the blend, after which the blend is compressed in order to bond the fibers together. In contrast, the instant invention does not involve the use of any pressure in order to achieve bonding.

U.S. Pat. No. 4,107,914 discloses a process for making a twistless staple yarn by bonding staple fiber together through the use of a solvent. The process described in U.S. Pat. No. 4,107,914 requires that ". . . the fiber strand is . . . bonded by bringing it in direct contact with a heated surface, e.g. a drum." In constrast, the method of the instant invention applies conductive mix to a substrate filament, and the filament, while wet with mix, is allowed to contact nothing but the atmosphere and the support yarn. Contact with any other object (e.g. a guide or drum) will result in the accumulation of excessive conductive mix on the object. The accumulation of conductive mix on an object, if dislodged onto the yarn, will cause a serious yarn and/or package defect.

U.S. Pat. No. 3,945,186 discloses a process of manufacturing a twistless (or low twist) staple fiber yarn, the yarn being made coherent by the addition of heated acid after a continuous filament yarn is added to staple fiber material. The process disclosed in U.S. Pat. No. 3,945,186 differs from the instant invention in that the process of making the supported antistatic yarn of the instant invention involves applying solvent to only the filamentary substrate (not the support yarn) followed by bringing the substrate and the support yarn together. This is to be contrasted with U.S. Pat. No. 3,945,186 which first brings both yarns together and then applies solvent to both yarns to achieve a bonding. It was unexpected (in the instant invention) that the application of solvent to only one of the yarns would permit bonding between the yarns to occur.

U.S. Pat. Nos. 3,291,897 and 3,206,923 both disclose twisted products which resemble the instant specification only remotely, in that they both provide a very different way of achieving the advantages of the present invention.

BRIEF SUMMARY OF THE INVENTION

The present invention is concerned with a supported, solvent-bonded antistatic yarn, a process of making same, and products resulting from the use of same. The product is an antistatic yarn which is bonded to a support yarn at intermittent points. It has been unexpectedly found that the process of the present invention enables one to bond an antistatic yarn to a support yarn at intermittent points, this bonding being effected without utilizing means to press the antistatic yarn and the support yarn together, contrary to prior art processes. Furthermore, it has been unexpectedly found that the product of the present invention, even though only intermittently bonded, performs significantly better (in downstream process operations) than prior art supported antistatic yarns, such as supported yarns made by twisting an antistatic yarn with a support yarn. It has also been unexpectedly found that in the process of the present invention it is necessary to keep the undried strand from contacting any object other than the support yarn, such as a guide.

It is an object of the invention to solvent-bond two yarns together in order to make a supported yarn.

It is a further object of the invention to solvent-bond an antistatic yarn to a nonconductive support yarn.

It is a further object of the invention to provide a supported antistatic yarn having improved downstream performance with respect to beaming, knitting and weaving.

It is a further object of the invention to provide more economical antistatic fabrics.

It is a further object of the invention to provide a "one step" process for making a supported, antistatic yarn from two nonconductive, nonbonded yarns.

It is a further object of the invention to produce a solvent-bonded, supported antistatic yarn without significantly reducing the sum of the strengths of the two yarns which are bonded together.

BRIEF DESCRIPTION OF THE DRAWINGS

FIG. 1 is a schematic representation of the most preferred embodiment of the present invention.

FIG. 2 is a schematic representation of an alternative process of carrying out the present invention.

FIG. 3 is a partial enlarged longitudinal view of the product of the present invention.

FIG. 4 is an enlarged view of a small portion of FIG. 3.

FIG. 5 is a cross sectional view of the product of the present invention, FIG. 5 being taken through line C—C of FIG. 4.

DETAILED DESCRIPTION OF THE PREFERRED EMBODIMENT

FIG. 1 is a schematic representation of the most preferred process for carrying out the present invention. A first pirn (1) having a first yarn (2) wound thereon supplies yarn (2) to a conductive mix applicator (3). The yarn (2) is most preferably a nylon-6 monofilamentary yarn. The conductive mix applicator (3), shown schematically, is comprised of a reservoir (which contains a conductive mix), the reservoir having an inlet orifice and an outlet orifice through which the yarn enters and exits the reservoir. Both orifices are sized slightly larger than the yarn diameter. The yarn exits the reservoir with a controlled amount of mix thereon. The mix is most preferably formic acid having nylon 6 polymer dissolved therein and conductive carbon black particles dispersed therein. The yarn is pulled off of the first pirn (1) by a pair of rollers (4), the surface speed of each roller (4) being set at approximately 700 meters per minute. Once the first yarn (2) emerges from the applicator (3), the first yarn (2) travels into an evaporation tube (5). As the first yarn, having mix thereon, approaches the entrance to the evaporation tube (5), a second yarn (6) is brought into close proximity with the first yarn (2), the second yarn (6) most preferably being a nylon-6 multifilament yarn, the second yarn (6) being supplied from a second pirn (7). It should be noted that the second yarn (6) is most preferably directed through a balloon guide (9) in order to confine the downstream motion of the second yarn (6). The second yarn (6) is brought into close proximity with the first yarn (2) by placing a guide (8) above the entrance to the evaporation tube (5). The guide (8) serves as a contact point for the second yarn (6), this contact point allowing the second yarn (6) to change directions so that immediately downstream of the guide (8), the direction of travel of the second yarn (6) and the first yarn (2) is essentially parallel. The speed of both yarns (2 and 6) is controlled by the rollers (4). Both yarns (2 and 6) travel at the same speed. The second yarn (6) is threaded over the guide (8) so that the second yarn (6) is between the guide (8) and the first yarn (2), the guide being positioned so that there is a distance ranging from 0 mm. to 3 mm. between the first yarn (2) and the second yarn (6) at the point at which the second yarn (6) contacts the guide (2). Most preferably the first yarn contacts the second yarn at the guide (i.e. the most preferred distance is 0 m.m.). However, it is also preferred that the path of travel of the first yarn is substantially undeflected (unchanged) by the guide and the support yarn. The first yarn (2) and the second yarn (6) travel into the evaporation tube in close proximity to one another, and it has been observed that the two yarns (2 and 6) tend to "jump together" slightly downstream of the guide (8) when a distance as great as 3 mm. is maintained between the yarns (2 and 6) at the guide (8). Most preferably the second yarn (6) is an interlaced yarn.

Once the yarns (6 and 2) enter the evaporation tube, the yarns are subjected to a counter-directional flow (about 600 meters per minute) of hot air (most preferably 150° C.), the hot air entering the evaporation tube at an inlet port (15) and exiting the evaporation tube at an exhaust port (10). The "break" (11) indicated in the figure is included in order to reveal the fact that the evaporation tube must be relatively long compared to the remainder of the process. Most preferably the distance from the first pirn (1) to the evaporation tube entrance is about 1 meter, while the length of the evaporation tube (5) is about 10 meters, and the distance from the evaporation tube exit to a yarn take-up pirn (12) is about 2 meters.

After the yarns (2 and 6) are merged at the guide (8), the mix applied to the first yarn (2) contacts and spreads into the second yarn (6) at points at which the first yarn (2) contacts the second yarn (6). As the yarns (2 and 6), now together, travel through the evaporation tube, the mix suffuses into both yarns (2 and 6) and causes intermittent solvent bonding to occur at the contact points. Thus, upon emerging from the downstream end of the evaporation tube (5), a supported antistatic yarn (13) has been formed by the solvent-bonding occurring between the two yarns (2 and 6) entering the evaporation tube (5). After emerging from the downstream end of the evaporation tube (5), the yarn (13) is directed around the rollers (4) which control the speed of the yarn, following which the yarn (13) is directed through a pigtail guide (14), following which the yarn is wound up onto the take-up pirn (12), the yarn (13) together with the take up pirn (12) forming a package of supported antistatic yarn.

FIG. 2 is a schematic of an alternative process of the invention. The process illustrated in FIG. 1 is used to make a "side-by-side" supported antistatic yarn, the "side-by-side" terminology referring to the fact that the first and second yarns (6 and 7) run in a simple side-by-side relationship downstream of the guide (8). However, in FIG. 2 the second pirn (7) has the first yarn (2) running longitudinally therethrough, the pirn (7) being hollow. The first yarn (2) is directed through the mix applicator (3) before it enters the second pirn (7), and the first yarn is directed through the center of a balloon guide (8A) after emerging from the second pirn (7). The second yarn (6) is taken off the second pirn (7) and is also directed through the balloon guide (8A). The first yarn (2) is aligned so that it travels through the center of the guide (8A), while the second yarn constantly remains on the inside surface of the balloon guide. Thus, the process illustrated in FIG. 2 "cables" the support yarn (6) around the antistatic yarn (2). The process illustrated in FIG. 2 is herein referred to as the "cabled process", which results in a "cabled supported antistatic yarn". The balloon guide (8A) most preferably has a 4 mm wide inside diameter. This guide (8A) is designated as being different from the guide (8) in FIG. 1. The alternative process illustrated in FIG. 2 requires a balloon guide, whereas the preferred process illustrated in FIG. 1 may use, in addition to a balloon guide, any other guide which will hold the second yarn (6) at the desired point alongside the path of the first yarn (2). Aside from the description above, the alternative process illustrated in FIG. 2 is no different from the preferred process illustrated in FIG. 1. The process of FIG. 1 is preferred for several reasons, including easier stringup and the convenience of using transfer tails on the second yarn (6), this convenience enabling a "nonstop" process not possible with the embodiment shown in FIG. 2.

FIG. 3 is a partial enlarged view of the product of the present invention. The supported conductive yarn (13) is shown in part, i.e. several nonconductive strands of the support yarn are not shown for the sake of simplicity. An antistatic monofilament (31) is shown in combination with three nonconductive filaments (34) which make up the support yarn (13). At two separate solvent-bonded points (32), the antistatic filament has been solvent bonded to a nonconductive filament (34).

FIG. 4 shows an enlarged close-up view of one of the solvent bonds (32) shown in FIG. 3. As can easily be seen in FIG. 4, at the solvent-bonded point (32) the mix on the antistatic monofilament (31) has spread onto the nonconductive filament (34) to which the antistatic monofilament (31) has solvent-bonded.

FIG. 5 is a cross sectional view of the filaments shown in FIG. 4, the cross sectional view being taken through section C—C shown in FIG. 4. FIG. 5 shows the antistatic filament (31) having an outer "coated" region (36) and an inner "suffused" region (35). The antistatic filament (31) is solvent bonded to the supporting (nonconductive) filament (34), with the supporting filament (34) having an outer "coated" region (38) partially around and an inner "suffused" region (37) also partially around. An interface region (39) is believed to exist between the antistatic filament (31) and the nonconductive filament (34). The interface region (39) is furthermore believed to resemble the outer "coated" regions (38 and 36).

In the process of the present invention, it is imperative that the support yarn be merged into contact with a filamentary substrate both after the substrate has been coated with a conductive solvent-containing mix, and before the solvent has substantially evaporated from the mix. Thus the support yarn is merged into close proximity (i.e. <3 mm) from the wet filamentary substrate at the guide (8) so that the two yarns will "jump together" in time for an adequate frequency of solvent-bonded "weld points" to occur. It is also imperative that the filamentary substrate, once wet with the mix, contacts only the support yarn and the atmosphere, or the mix will accumulate on any contact point and eventually will be picked up and carried by the substrate or the support yarn. Any sizeable accumulation (i.e. a lump) of mix will probably contain so much solvent that it will fail to dry on the evaporation tube and will fuse windings of yarn together on the package, ruining the remainder of the package for downstream processing operations.

As implied in the description and drawing above, the present invention is concerned with a "one-step" process, i.e., a continuous process, in that suffusion and solvent-bonding steps are performed without interruption of the yarn forwarding process. In order to simplify the claims herein, the "first yarn" (i.e. the yarn which is to become conductive, is referred to as the "polymeric substrate," a term which is hereby defined to include polymeric strand materials.

EXAMPLE

A conductive mix applicator was constructed from a first pipe having a length of 55 m.m. and an i.d. of 10 m.m. The first pipe was vertically oriented and securely mounted. From the side, a second ppipe was connected to the midpoint of the first pipe. The second pipe had a shutoff valve thereon a short way back from the intersection of the second pipe with the first pipe. The shutoff valve was closed. The second pipe was connected to a pressurized source of conductive mix. Two jeweled bearings (synthetic sapphire watch bearings) were obtained from A. M. Gatti, Inc., 524 Tindall venue, Trenton, N.J. Each jeweled bearing had an outside diameter of 1.5 m.m. and a centrally located orifice having adiameter of 75 microns, and each bearing had a thickness of 0.5 millimeters. The bearings were swaged into stainless steel disks which had a diameter of 13 m.m. and a thickness of 1 millimeter. Each disk had a through hole which was centered and was 1.3 m.m. in diameter, the through hole having a counterbore 1.6 m.m. in diameter and 0.5 m.m. deep. The bearings were swaged into the counterbores. After both of the bearings were swaged into the counterbores, the disks were clamped onto the ends of the first pipe (i.e. each disk/bearing combination formed a "cap" on the ends of the first pipe). The bearings were about 55 m.m. apart. The clamping was performed so that watertight seals were formed between the pipe and the caps. The combination of the bearings, the disks, and the first pipe constitutes the conductive mix applicator.

A 20 denier polycaprolactam monofilamentary yarn, having a diameter of 50 microns, was supplied from a first pirn mounted above the mix appliator. The cap on the upper end of the first pipe was removed, and the monofilament was threaded through the 75 micron orifice by hand. Several inches (about 10 inches) of monofilament were pulled through the orifice. The bottom cap was removed from the pipe and the upper cap was held close to the upper end of the first pipe while a slight vacuum was applied to the bottom of the first pipe. The airflow created by the vacuum caused the 10 inches of monofilament to be directed through the first pipe. The upper cap was then reclamped, with the monofilament threaded through both the upper cap (i.e. bearing) and the first pipe. The monofilament was then threaded through the lower bearing, after which the lower cap was reclamped in position. The monofilament was then pulled downward towards the upper end of the evaporation tube. A second polycaprolactam yarn was located on a pirn above and to the side of the upper end of the evaporation tube, as shown in FIG. 1. The second yarn was a 140 denier, 36 filament yarn. Both yarns were obtained from Badische Corporation of Anderson, S.C. A yarn guide bar was positioned immediately above the upstream end of the evaporation tube and was aligned very close to the path which the monofilament would ultimately take after completion of stringup. The second yarn (the multifilament yarn) was passed over the guide, the second yarn changing direction of travel by contacting the guide bar. The second pirn had an associated balloon guide which positioned the second yarn on the guide bar at a point between the guide bar and the point at which the first yarn came closest to the guide bar. The guide bar was aligned so close to the path of the first yarn that the first yar barely touched the second yarn, but the path of the first yarn was not substantially deflected nor did the first yarn ever touch the guide bar once stringup was complete. Both yarns were then directed through a 10 meter long evaporation tube and wound twice around a pair of rollers, as shown in FIG. 1. Both rollers had a surface speed of 690 meters per minute, with the larger roller having a diameter of about 10 centimeters and the smaller rller having a diameter of about 2.5 centimeters. The winding of both yarns on a single take-up pirn was then begun as shown in FIG. 1.

A conductive mix was made by dispersing 6 parts (by weight) of conductive carbon black into 4 parts of polycaprolactam chip and 90 parts of 70% formic acid. The carbon black particles were obtained from Cabot Corporation of 200 Raritan Center Parkway, Edison, N.J. 08817. The carbon black was labeled Vulcan XC-72R. The polycaprolactam chip was obtained from Badische Corporation, Freeport, Tex., the chip being designated as Nylon 6 grade 206 chip.

After the winding of the yarns was begun, the valve leading to the mix applicator was opened, filling the reservoir with mix. The stringup procedure must be performed as described above because the monofilament will completely disintegratre within about 3 seconds if the acid remains substantially unevaporated thereon.

The product of the above described process had intermittent solvent bonds averaging 5 m.m. to 10 m.m. apart. If the gap (between the first and second yarns) at the guide was widened to as much as 3 m.m., the solvent bonds may average one every 200 m.m., and the product still shows improved beaming over other prior art supported yarns, such as twisted yarns. The product made from the process described above was a 161 denier 37 filament supported antistatic yarn which had a breaking strength of about 4.4 grams per denier. The breaking strength of both original yarns was approximately 4.4 grams per denier. The mix added approximately 1 denier to the sum of the original yarn deniers. The product of this example is a "side-by-side" supported, solvent-bonded, antistatic yarn, which is the most preferred product of the present invention.

The yarn made by the process of this example was used in the manufacture of Polypropylene Carpet Primary Fabric. The fabric was manufactured by Amoco Fabrics, South Hamilton Street, Dalton, Ga. 30720. The fabric was designated Polybac AS, style number 2605.

We claim:

1. A continuous method of making a supported antistatic yarn, the method comprising the steps of:

(a) suffusing finely divided, electrically conductive particles into a polymeric filamentary substrate by applying a dispersion of particles in a liquid, the liquid being a solvent for the substrate; and (b) contacting the filamentary substrate with a support yarn before the solvent applied to the filamentary substrate has evaported, the solvent being a solvent for both the filamentary substrate and the support yarn; and (c) evaporating the solvent so that the filamentary substrate is intermittently solvent-bonded to the support yarn.

2. A method of making a supported antistatic yarn as described in claim 1, the method comprising the steps of:

(a) applying to a traveling filamentary polymer substrate a dispersion of finely-divided electrically conductive particles, in an amount sufficient to render an electrical resistance of not more than $10^9$ ohms/cm, the dispersion of particles being in liquid which is a solvent for the filamentary polymer substrate but does not dissolve or react with the electrically conductive particles; and (b) merging a traveling support yarn into contact with the substrate traveling at substantially the same speed, the liquid being both a solvent for the substrate and the support yarn, the merging being accomplished without substantially altering the direction of travel of the filamentary substrate, the merging being accomplished before a substantial amount of solvent has evaporated therefrom, the merging being accomplished while allowing the filamentary substrate to contact only the atmosphere and the support yarn until the solvent has substantially evaporated therefrom; and (c) passing the merged support yarn and substrate through an evaporation zone in which the support yarn and substrate are in longitudinal contact, the evaporation tube evaporating the solvent which was applied to the filamentary substrate whereby the filamentary substrate is intermittently solvent-bonded to the support yarn.

3. A method of making a supported antistatic yarn as described in claim 2, the method comprising the steps of:

(a) applying to a traveling filamentary polymer substrate a dispersion of finely-divided electrically conductive particles, in an amount sufficient to render an electrical resistance of not more than $10^9$ ohms/cm, the dispersion of particles being in liquid which is a solvent for the filamentary polymer substrate but does not dissolve or react with the electrically conductive particles; and (b) changing the direction of travel of a traveling support yarn with a guide to effect a merging of the support yarn into contact with the substrate traveling at substantially the same speed, the liquid being a solvent for both the substrate and the support yarn, the merging being accomplished without substantially altering the direction of travel of the filamentary substrate, the merging being accomplished before a substantial amount of solvent has evaporated therefrom, the merging being accomplished while allowing the filamentary substrate to contact only the atmosphere and the support yarn until the solvent has substantially evaporated therefrom; and (c) passing the merged support yarn and substrate through an evaporation zone which the support yarn and substrate are in longitudinal contact, the evaporation tube evaporating the solvent which was applied to the filamentary substrate whereby the filamentary substrate is intermittently solvent-bonded to the support yarn.

4. A method as described in claim 3 wherein the merging of the support yarn into the filamentary substrae is done so that the filamentary substrate and the support yarn are brought together in a side-by-side relationship.

5. A method as described in claim 4 wherein at the guide the distance between the support yarn and the filamentary substrate is less than 3 millimeters, and the path of travel of the filamentary substrate is substantially undeflected by the support yarn.

6. A method as described in claim 4 wherein both the support yarn and the filamentary substrate are polyamides.

7. A method as described in claim 4 wherein the solvent is formic acid.

* * * * *